US012000403B2

(12) United States Patent
Hardy et al.

(10) Patent No.: US 12,000,403 B2
(45) Date of Patent: Jun. 4, 2024

(54) STATOR SAVER ARRANGEMENT FOR CANNED MOTOR PUMP

(71) Applicant: Hayward Tyler, Inc, Colchester, VT (US)

(72) Inventors: Benjamin Gardiner Hardy, Colchester, VT (US); Patrick Aron DiRico, Essex Junction, VT (US); Drew James Van Norman, Swanton, VT (US)

(73) Assignee: HAYWARD TYLER, INC., Colchester, VT (US)

( * ) Notice: Subject to any disclaimer, the term of this patent is extended or adjusted under 35 U.S.C. 154(b) by 0 days.

(21) Appl. No.: 17/738,597

(22) Filed: May 6, 2022

(65) Prior Publication Data

US 2023/0358238 A1 Nov. 9, 2023

(51) Int. Cl.

| | |
|---|---|
| ***F04D 13/06*** | (2006.01) |
| ***F04D 29/046*** | (2006.01) |
| ***F04D 29/58*** | (2006.01) |

(52) U.S. Cl.

CPC ..... *F04D 13/0633* (2013.01); *F04D 29/046* (2013.01); *F04D 29/5806* (2013.01)

(58) Field of Classification Search

CPC ..... F04D 13/0633; F04D 29/046; F04D 29/0462; F04D 29/047; F04D 29/0563; F04D 29/056; F04D 29/057; F16C 17/02; F16C 17/20; F16C 17/26; H02K 7/08; H02K 7/083

See application file for complete search history.

(56) References Cited

U.S. PATENT DOCUMENTS

| | | | | |
|---|---|---|---|---|
| 5,202,598 | A * | 4/1993 | Katsumata | F16C 32/0442 310/91 |
| 2003/0160525 | A1 | 8/2003 | Kimberlin et al. | |
| 2005/0052089 | A1* | 3/2005 | Horng | F16C 35/02 310/90 |
| 2017/0130772 | A1* | 5/2017 | Lai | F16C 33/109 |

FOREIGN PATENT DOCUMENTS

| | | | |
|---|---|---|---|
| CN | 109322840 | A | 2/2019 |
| CN | 111188775 | A | 5/2020 |
| CN | 113389737 | A | 9/2021 |
| WO | 2014/139623 | A1 | 9/2014 |

OTHER PUBLICATIONS

USPTO "International Search Report and Written Opinion" for corresponding International (PCT) Application No. PCT/US2023/021128, dated Jul. 28, 2023, 8 pp.

* cited by examiner

*Primary Examiner* — Kenneth J Hansen

(74) *Attorney, Agent, or Firm* — Eckert Seamans Cherin & Mellott, LLC

(57) ABSTRACT

A limit ring for use in a pump arrangement includes a cylindrical body positioned about a central longitudinal axis, a first end and an opposite second end. A central passage is defined through the cylindrical body and is centered about, and extends, along the longitudinal axis between the first end and the second end. The central passage has a circular cross section when viewed along the longitudinal axis. The limit ring further includes a number of channels defined in the cylindrical body radially outward from the central passage, each channel extending between the first end and the second end of the cylindrical body.

9 Claims, 6 Drawing Sheets

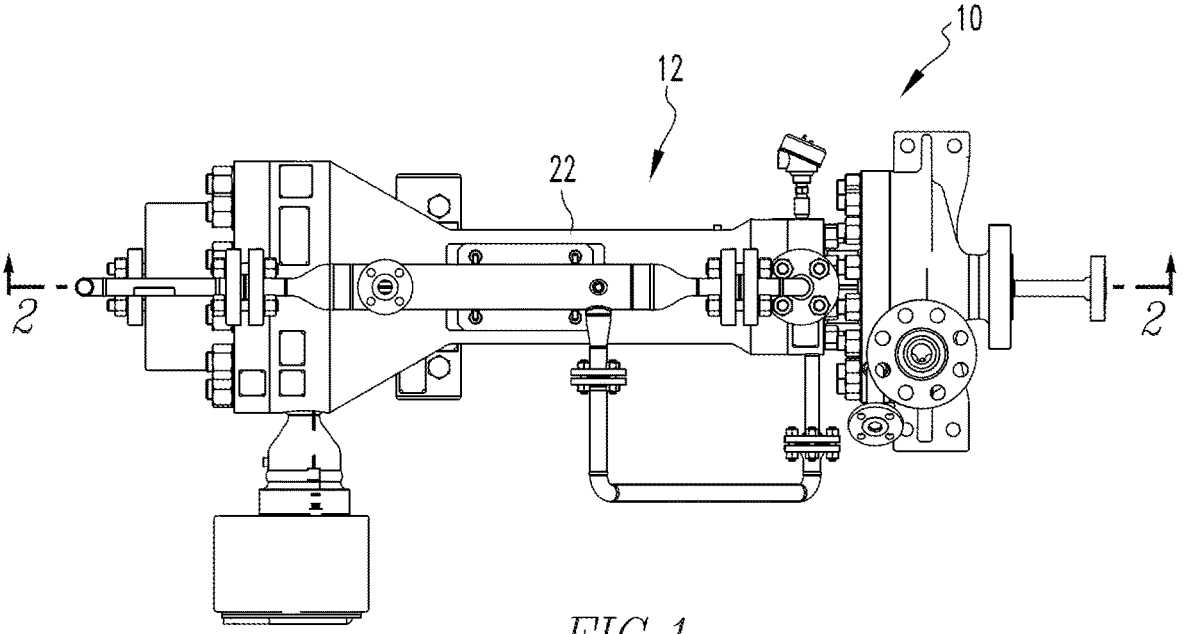
FIG.1
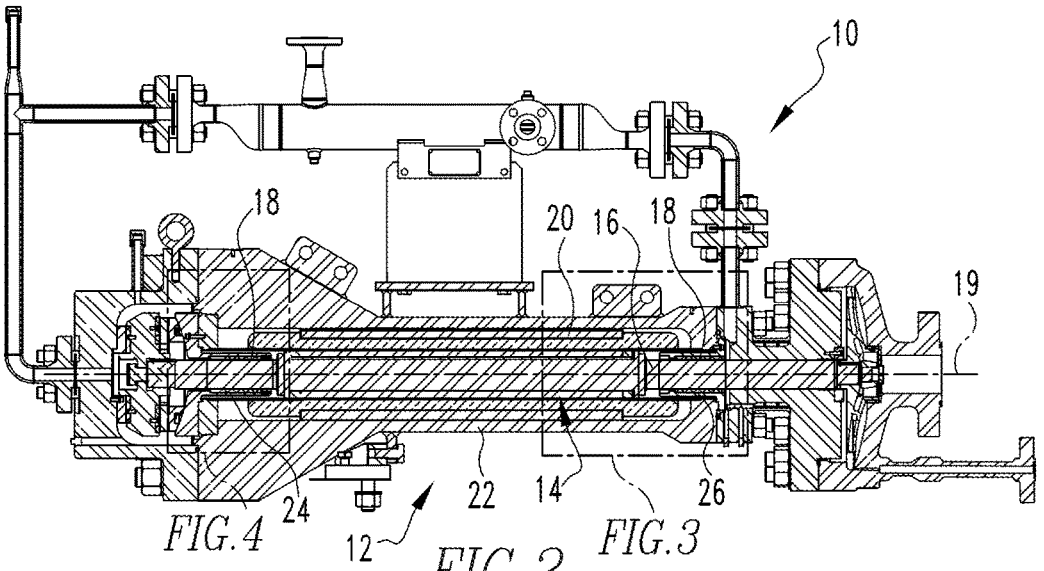
FIG.4 FIG.3
FIG.2

STATOR SAVER ARRANGEMENT FOR CANNED MOTOR PUMP

BACKGROUND

1. Field

The disclosed concept pertains generally to canned motor pumps, and more particularly to canned motor pumps having arrangements therein for preventing damage to the stator thereof in the event of a bearing failure. The disclosed concept further pertains to arrangements for use in preventing damage to bearings, and more particularly to arrangements used in canned motor pumps for preventing damage to bearings associated therewith. The disclosed concept further relates to kits for retrofitting canned motor pumps with arrangements for preventing damage to the stator thereof in the event of a bearing failure.

2. Description of the Related Art

Canned motor pumps are known for long life under normal operation. A canned motor pump is a pump and electric motor positioned/connected on a common shaft. The rotating element consists of an impeller, a shaft, and an assembly of electrical components referred to as the rotor. The rotor may be of differing arrangements. For example, without limitation, the rotor may be a squirrel cage induction type with laminations, rotor bars, and end rings, all enclosed by a thin cylindrical metal sheet referred to as the rotor can.

The stationary portion of the electric motor is the stator, and consists of magnet wire and laminations, and is also enclosed in a cylindrical metal can (stator can). The aforementioned cans (i.e., rotor and stator cans) protect the electrical parts of the motor from the process fluid, which is circulated within the motor as a coolant. Typically the rotor is supported by two or more radial bearings that center the rotor within the stator and provide stability and electrical balancing. A flaw of conventional canned motor pumps is that when the radial bearings wear, the annular gap between the stator and rotor closes, causing the stator and rotor to contact, typically resulting in tearing of the stator can and the influx of process fluid. The influx of process fluid causes the motor to short. Such failure is a very expensive failure when it occurs. Depending on the process fluid, the stator may be fouled and not recoverable for repair.

Hence, there exists a need for an improved arrangement that reduces and/or eliminates such failures that commonly result from wear of the radial bearings.

SUMMARY

Embodiments of the disclosed concept address shortcomings of conventional arrangements by providing solutions that reduce/eliminate failures that commonly result from wear of a radial bearing or bearings. As one aspect of the disclosed concept, a limit ring for use in a pump arrangement is provided. The limit ring comprises: a cylindrical body positioned about a central longitudinal axis and having a first end and an opposite second end; a central passage defined through the cylindrical body centered about, and extending along the longitudinal axis between the first end and the second end, the central passage having a circular cross section when viewed along the longitudinal axis; and a number of channels defined in the cylindrical body radially outward from the central passage, each channel extending between the first end and the second end.

The number of channels may comprise a plurality of channels.

Each channel of the number of channels may open into the central passage.

Each channel of the number of channels may open outward from the cylindrical body.

Each channel of the number of channels may extend in a straight line parallel to the longitudinal axis.

The cylindrical body may be formed from a high friction material.

As another aspect of the disclosed concept, a canned motor pump is provided. The canned motor pump comprises: a main housing; a rotor having a shaft extending from both a first end and an opposite second end of the rotor; a first radial bearing positioned in a first bearing support coupled to the main housing, the first radial bearing supporting the shaft extending from the first end of the rotor; a second radial bearing positioned in a second bearing support coupled to the main housing, the second radial bearing supporting the shaft extending from the second end of the rotor; a stator having a generally tubular shape positioned within the main housing radially outward from the rotor such that an annular gap is defined between the rotor and the stator; and a limit ring positioned adjacent at least one of the first or second radial bearings, wherein the limit ring comprises: a cylindrical body positioned about a central longitudinal axis and having a first end and an opposite second end; a central passage defined through the cylindrical body centered about, and extending along the longitudinal axis between the first end and the second end, the central passage having a circular cross section when viewed along the longitudinal axis; and a plurality of channels defined in the cylindrical body radially outward from the central passage, each channel extending between the first end and the second end, wherein the limit ring is positioned about the shaft extending from one of the first end of the rotor or the second end of the rotor such that the shaft extends through the central passage of the limit ring, and wherein a portion of the limit ring between a pair of the channels is spaced a distance from an adjacent portion of the canned motor pump that is less than a minimum distance between the rotor and the stator.

Each channel of the plurality of channels of the limit ring may open into the central passage of the limit ring.

Each channel of the plurality of channels of the limit ring may open outward from the cylindrical body of the limit ring.

Each channel of the plurality of channels may extend in a straight line parallel to the longitudinal axis.

The cylindrical body of the limit ring may be formed from a high friction material.

The limit ring may be a first limit ring; the first limit ring may be positioned adjacent the first radial bearing and positioned about the shaft extending from the first end of the rotor such that the shaft extends through the central passage of the first limit ring; the canned motor pump may comprise a second limit ring that comprises: a cylindrical body positioned about a central longitudinal axis and having a first end and an opposite second end; a central passage defined through the cylindrical body centered about, and extending along the longitudinal axis between the first end and the second end, the central passage having a circular cross section when viewed along the longitudinal axis; and a plurality of channels defined in the cylindrical body radially outward from the central passage, each channel extending between the first end and the second end; the second limit ring positioned adjacent the second radial bearing about the shaft extending from the second end of the rotor such that the shaft extends through the central passage of the second limit ring; and a portion of the second limit ring between a pair of the channels of the second limit ring is spaced a distance from an adjacent portion of the canned motor pump that is less than the minimum distance between the rotor and the stator.

The limit ring may be positioned in one of the first bearing support or the second bearing support; each channel of the plurality of channels of the limit ring may open into the central passage of the limit ring; and the portion of the limit ring between the pair of the channels of the limit ring may be spaced the distance from the shaft extending from the first end of the rotor or the second end of the rotor.

The limit ring may be positioned in a portion of the stator; each channel of the plurality of channels of the limit ring may open into the central passage of the limit ring; and the portion of the limit ring between the pair of the channels of the limit ring may be spaced the distance from the shaft extending from the first end of the rotor or the second end of the rotor.

The limit ring may be positioned about the shaft extending from the first end of the rotor or the second end of the rotor; each channel of the plurality of channels of the limit ring may open outward from the cylindrical body of the limit ring; and the portion of the limit ring between the pair of the channels of the limit ring may be spaced the distance from a portion of the stator.

As yet a further aspect of the disclosed concept, a kit for retro-fitting a canned motor pump is provided. The kit comprises: a limit ring comprising: a cylindrical body positioned about a central longitudinal axis and having a first end and an opposite second end; a central passage defined through the cylindrical body centered about, and extending along the longitudinal axis between the first end and the second end, the central passage having a circular cross section when viewed along the longitudinal axis; and a number of channels defined in the cylindrical body radially outward from the central passage, each channel extending between the first end and the second end; and a bearing support having a first portion structured to house the limit ring therein and a second portion structured to be coupled to a housing of the canned motor pump.

The kit may further comprise a radial bearing and the bearing support may be further structured to house the radial bearing therein adjacent the limit ring.

The kit may further comprise a second limit ring comprising: a cylindrical body positioned about a central longitudinal axis and having a first end and an opposite second end; a central passage defined through the cylindrical body centered about, and extending along the longitudinal axis between the first end and the second end, the central passage having a circular cross section when viewed along the longitudinal axis; and a number of channels defined in the cylindrical body radially outward from the central passage, each channel extending between the first end and the second end.

The kit may further comprise a second bearing support having a first portion structured to house the second limit ring therein and a second portion structured to be coupled to the housing of the canned motor pump.

The kit may further comprise a second radial bearing and the second bearing support may be further structured to house the second radial bearing therein adjacent the second limit ring.

These and other objects, features, and characteristics of the disclosed concept, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosed concept.

BRIEF DESCRIPTION OF THE DRAWINGS

FIG. 1 is an exterior plan view of a pump arrangement including a canned motor pump in accordance with an example embodiment of the disclosed concept;

FIG. 2 is a sectional view of the canned motor pump of FIG. 1 taken along line 2-2 of FIG. 1;

DETAILED DESCRIPTION OF EXEMPLARY EMBODIMENTS

Figure 3:
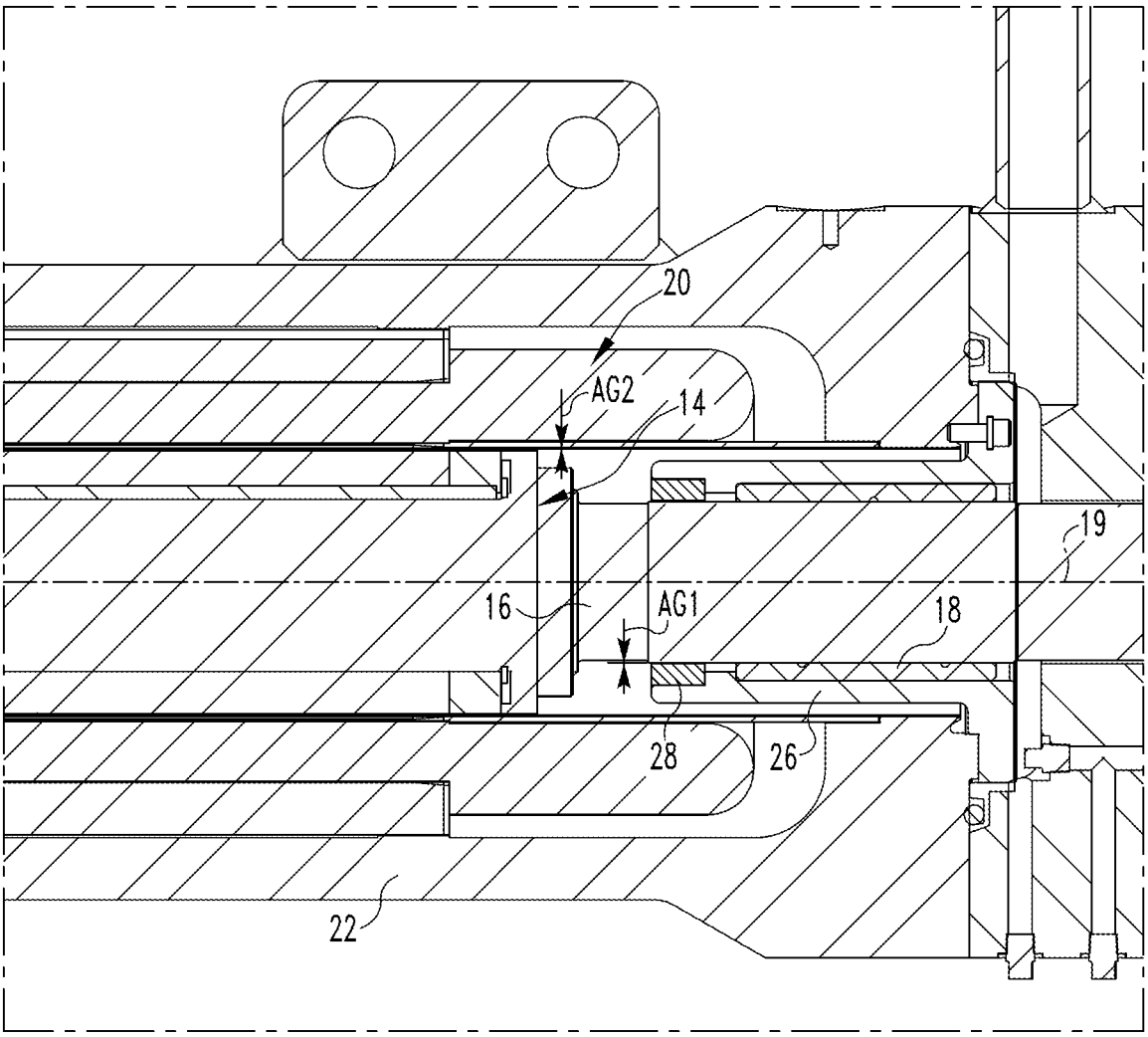
FIG. 3 is an enlarged detail view of the portion of the view of FIG. 2 as indicated therein.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are coupled in direct contact with each other. As used herein, "fixedly coupled" or "fixed" means that two components are coupled so as to move as one while maintaining a constant orientation relative to each other.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As used herein, the statement that two or more parts or components "engage" one another shall means that the parts exert a force against one another either directly or through one or more intermediate parts or components.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening is/are made from a deformable or compressible material, the opening may even be slightly smaller than the component being inserted into the opening (i.e., an interference fit). This definition is further modified if the two components are said to "substantially correspond." "Substantially correspond" means that the size of the opening is very close to the size of the element inserted therein. That is, not so close as to cause substantial friction, as with a snug fit, but with more contact and friction than a "corresponding fit," i.e. a "slightly larger" fit.

A top view of a pump arrangement 10 including a canned motor pump 12 in accordance with one example embodiment of the disclosed concept is shown in FIG. 1. Overall, canned motor pump 12 operates in the same manner as a conventional canned motor pump as known in the art and thus a detailed description of most of the elements thereof as well as general operation of canned motor pump 12 are not included herein. From the exterior, canned motor pump 12 does not appear any different than a conventional canned motor pump. Referring to the sectional view of FIG. 2, like a conventional canned motor pump such as discussed in the Background, canned motor pump 12 includes a rotor 14 positioned on a shaft 16 supported by radial bearings 18, through which shaft 16 snugly passes (such as commonly known). Radial bearings 18 are positioned generally at or near each end of rotor 14 providing for rotor 14 and shaft 16 to rotate freely about a central longitudinal rotation axis 19. Canned motor pump 12 also includes a stationary stator 20 having a generally tubular shape that is positioned radially outward from rotor 14, such as shown in FIG. 2. Such arrangement provides for rotor 14 and shaft 16 to be rotatable within stator 20. The aforementioned elements are positioned within a main housing 22 of canned motor pump 12. Similar to a conventional canned motor pump, each radial bearing 18 is supported within a respective bearing support 24, 26 that is coupled directly or indirectly to main housing 22.

Figure 4:
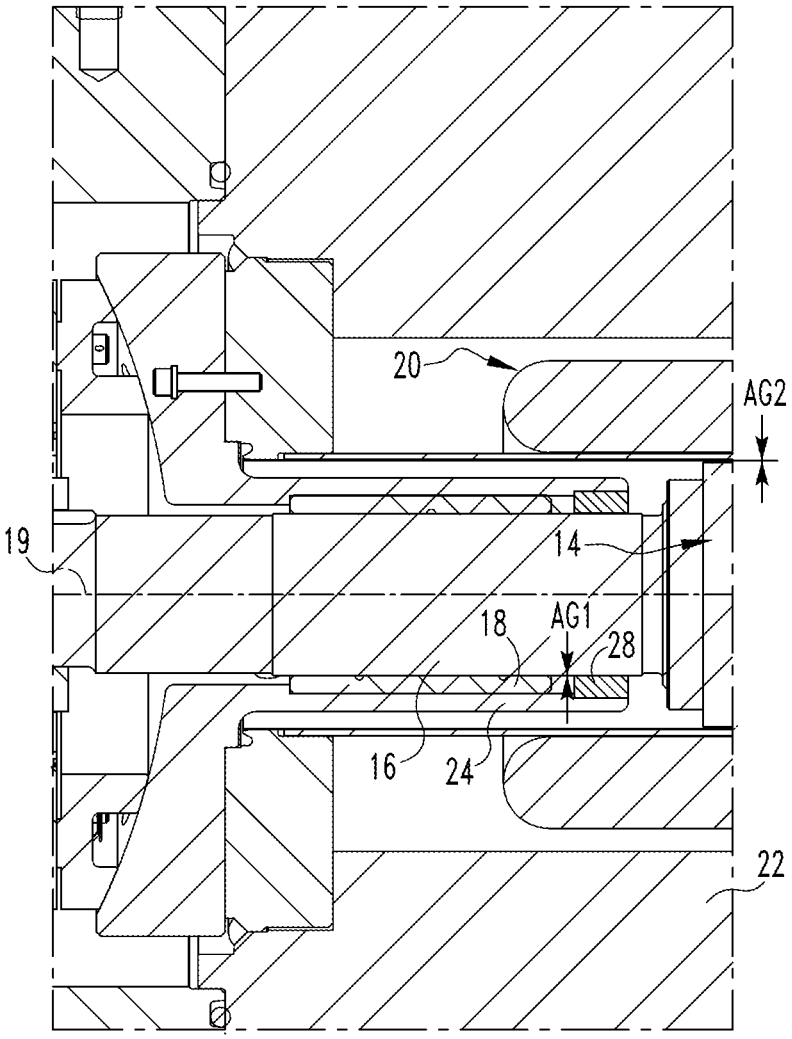
FIG. 4 is an enlarged detail view of the portion of the view of FIG. 2 as indicated therein.

Continuing to refer to FIG. 2, and more particularly to the detailed views of the portions thereof shown in FIGS. 3 and 4, unlike a conventional canned motor pump, each bearing support 24 and 26 of canned motor pump 12 not only supports a respective one of radial bearings 18, but also supports a limit ring 28 snugly disposed therein in accordance with an example embodiment of the disclosed concept, through each of which shaft 16 passes. The purpose of each limit ring 28 is discussed further below.

Figure 5:
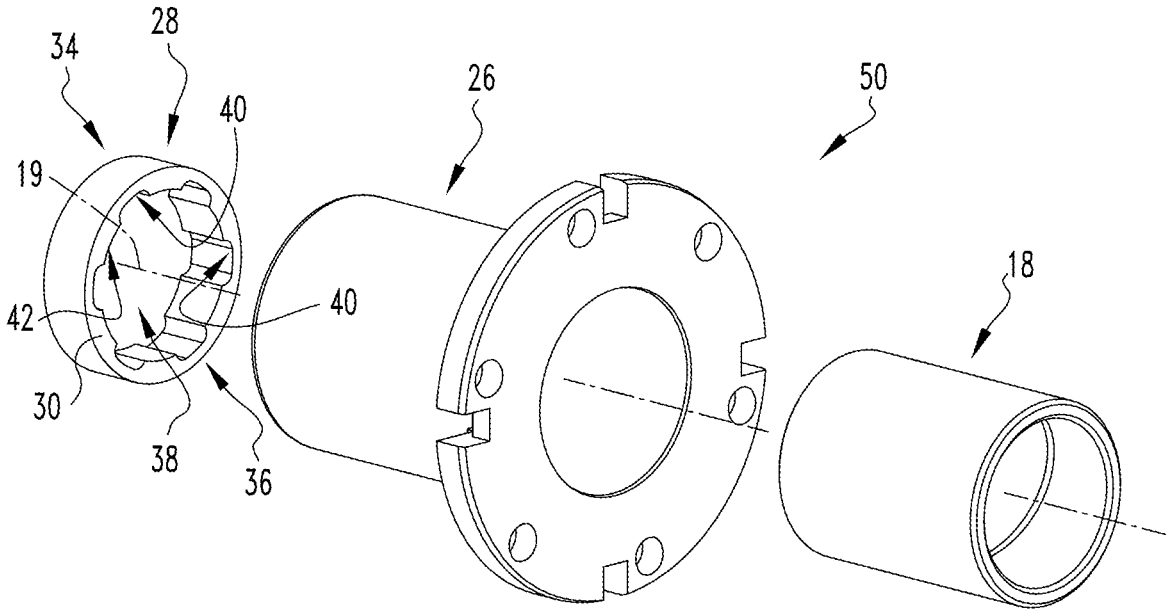
FIG. 5 is an exploded view showing a bearing support, bearing, and limit ring in accordance with an example embodiment of the disclosed concept such as shown in the detail view of FIG. 3.
Figure 6:
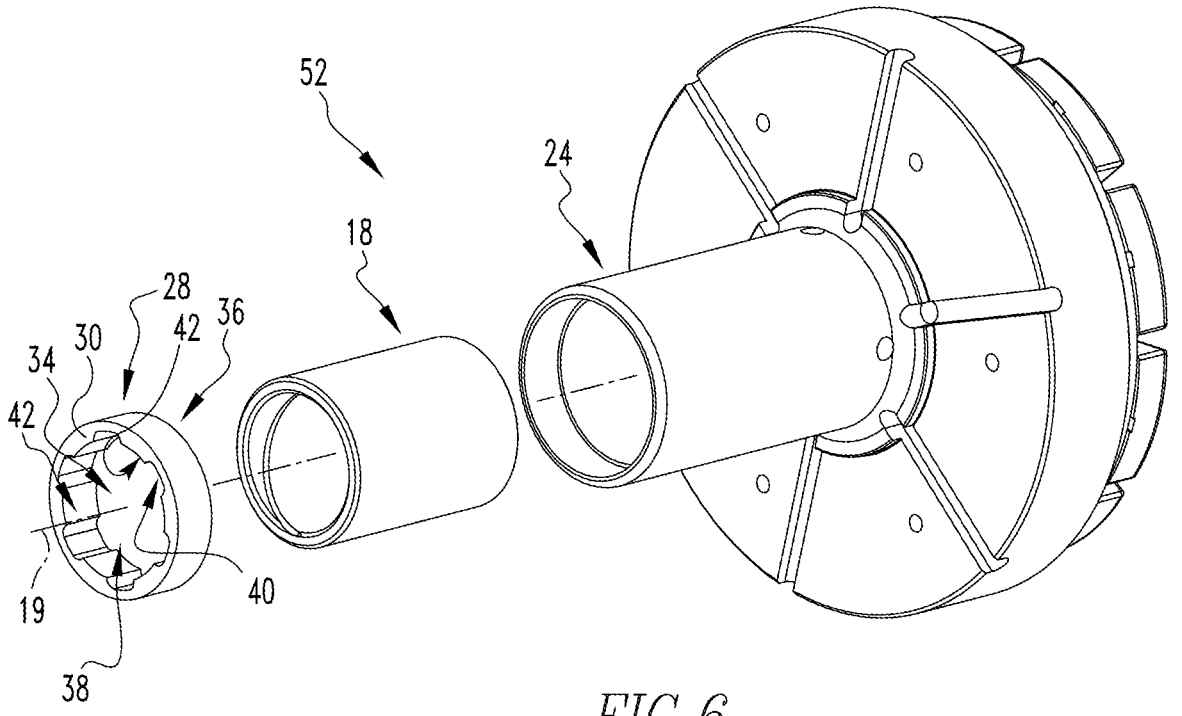
FIG. 6 is an exploded view showing a bearing support, bearing, and limit ring in accordance with an example embodiment of the disclosed concept such as shown in the detail view of FIG. 4.
Figure 7:
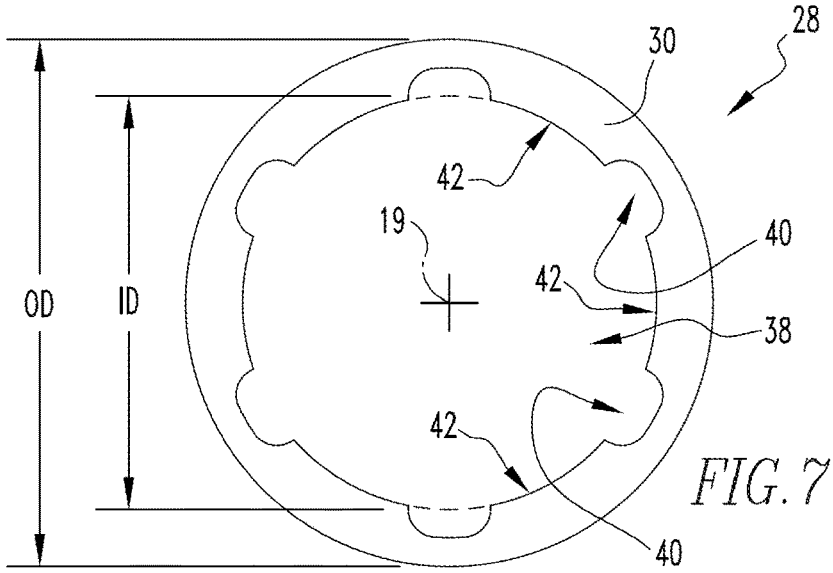
FIG. 7 is an end view of a limit ring such as shown in FIGS. 5 and 6.

Continuing to refer to FIGS. 3 and 4, as well as to the exploded views of FIGS. 5 and 6 and the end view of FIG. 7, each limit ring 28 includes a cylindrical body 30 positioned about longitudinal rotation axis 19 and having a first end 34 and an opposite second end 36 spaced along longitudinal rotation axis 19. Limit ring 28 further includes a central passage 38 defined in and through cylindrical body 30 that is centered about, and extends along longitudinal rotation axis 19 through cylindrical body 30 between first end 34 and second end 36. Central passage 38 has a circular cross section when viewed along longitudinal rotation axis 19, such as shown in FIG. 7. Accordingly, as shown in FIG. 7, cylindrical body 30 is generally defined by an inner diameter ID and an outer diameter OD oriented perpendicular to longitudinal rotation axis 19. In addition to central passage 38, limit ring 28 further includes a plurality of channels 40 defined in cylindrical body 30 radially outward from central passage 38, with each channel 40 extending between first end 34 and second end 36 along central passage 38. As can be seen in FIGS. 5-7, the example limit ring 28 includes a total of six channels 40, with each channel 40 having an opening running along, and opening into, central passage 38. Further, each channel of the plurality of channels extends in a straight line parallel to longitudinal rotation axis 19. Each adjacent pair of channels 40 defines a lobe 42 of limit ring 28. Hence, the example limit ring 28 shown in FIGS. 5-7 includes six lobes 42. However, it is to be appreciated that one or more of the quantity, shape, and/or spacing of each channel 40/lobe 42 can be varied without varying from the scope of the disclosed concept.

Each limit ring 28 and associated radial bearing 18 are aligned by a respective bearing support 24 or 26 about shaft 16 to provide tightly controlled running clearances. Each limit ring 28 functions to prevent contact between rotor 14 and stator 20 in the event of failure of one or both of radial bearings 18 by supporting shaft 16 before such contact between rotor 14 and stator 20 can occur. Accordingly, in the example shown in FIGS. 2-7, inner diameter ID of cylindrical body 30 of each limit ring 28 is sized such that an annular gap AG1 (FIG. 3) between cylindrical body 30 and shaft 16, i.e., the gap between the inner surfaces of lobes 42 and shaft 16, is less than an annular gap AG2 (FIG. 3) between rotor 14 and stator 20. Hence, in the event that either or both radial bearings 18 fail, contact occurs between shaft 16 and limit ring 28 before any contact between rotor 14 and stator 20.

Each limit ring 28 is formed from a high friction material that increases amp draw due to drag on rotating shaft 16 when shaft 16 engages limit ring 28, thus tripping power to the motor before the bearing(s) is/are destroyed. In example embodiments of the disclosed concept, limit rings 28 formed from non-asbestos organics (NAOs, e.g., brake pad material) and ceramics, although other materials that can both provide abrasive friction to the metal shaft 16 may be employed without varying from the scope of the disclosed concept. For example, semi-metallics containing metallic fibers in a non-metallic binder that provides abrasive friction may be employed. Additionally, varying the surface finish of shaft 16 and the limit ring 28 can also increase friction between limit ring 28 and shaft 16. When installed about shaft 16, the arrangement of channels 40/lobes 42 of limit ring 28 provides for a limited number of close touch points between shaft 16 and limit ring 28 such that coolant can flow through channels 40 with very little to no impedance.

As a non-limiting example, in one embodiment of a canned motor pump 12 in accordance with the disclosed concept, an annular gap AG2 between rotor 14 and stator 20 of 0.026 inches was employed with a bearing clearance of 0.002 inches. The annular gap AG1 between cylindrical body 30 of limit ring 28 and shaft 16 is set at a point that is greater than maximum bearing clearance but less than the rotor-to-stator clearance, i.e. AG2. In this example, annular gap AG1 was set at 0.016 inches so that in the event of a bearing failure shaft 16 contacts limit ring 28 before rotor 14 contacts stator 20 and initiates the motor current and vibration previously noted. Although shown with limit ring 16 positioned between radial bearing 18 and rotor 14, it is to be appreciated that limit ring 16 may be positioned axially outward from radial bearing 18 (i.e., radial bearing 18 positioned between limit ring 16 and rotor 14) without varying from the scope of the disclosed concept.

Figure 8:
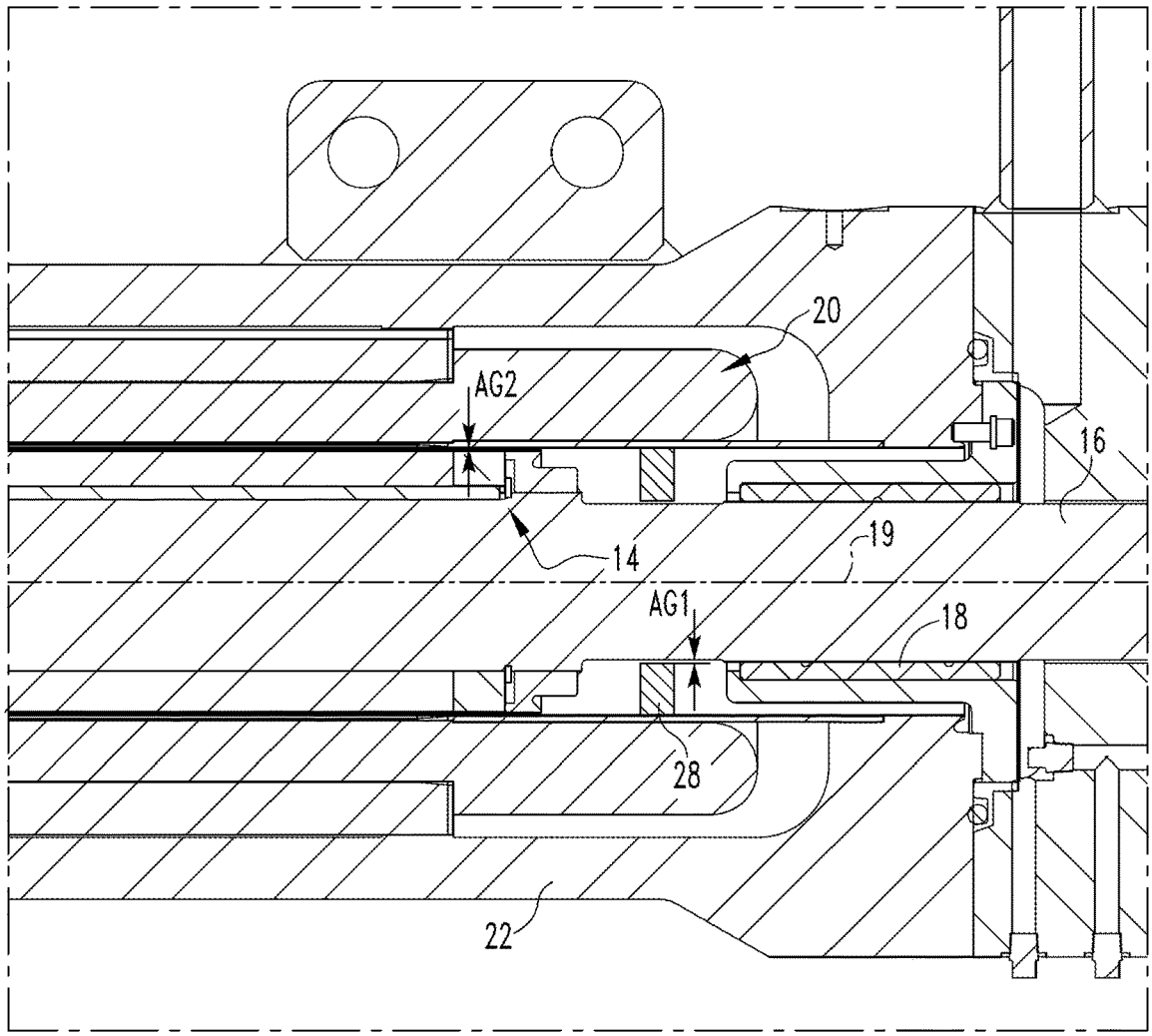
FIG. 8 is a detail view similar to the detail view of FIG. 3 of a canned motor pump but having a limit ring positioned in accordance with another example embodiment of the disclosed concept.

FIG. 8 shows a detail sectional view similar to the detail sectional view of FIG. 3 of a similar portion of a similar canned motor pump in accordance with another example embodiment of the disclosed concept in which a slightly differently dimensioned version of limit ring 28 is utilized in a similar manner but in a different location. Unlike the previous example embodiment shown in FIGS. 2-6, in the example embodiment of FIG. 8 limit ring 28 is fit (e.g., snugly corresponding fit) within stator 20 at or near an end thereof. Like the previous embodiment, inner diameter ID of cylindrical body 30 of limit ring 28 is sized such that annular gap AG1 between cylindrical body 30 and shaft 16 is present that is less than annular gap AG2 between rotor 14 and stator 20. Such an arrangement would be the same at the opposite end of stator 20. Hence, in the event that either or both radial bearings 18 fail, contact would occur between shaft 16 and limit ring 28 before any contact between rotor 14 and stator 20, thus causing the increases amp draw and tripping of the motor such as previously discussed.

Figure 9:
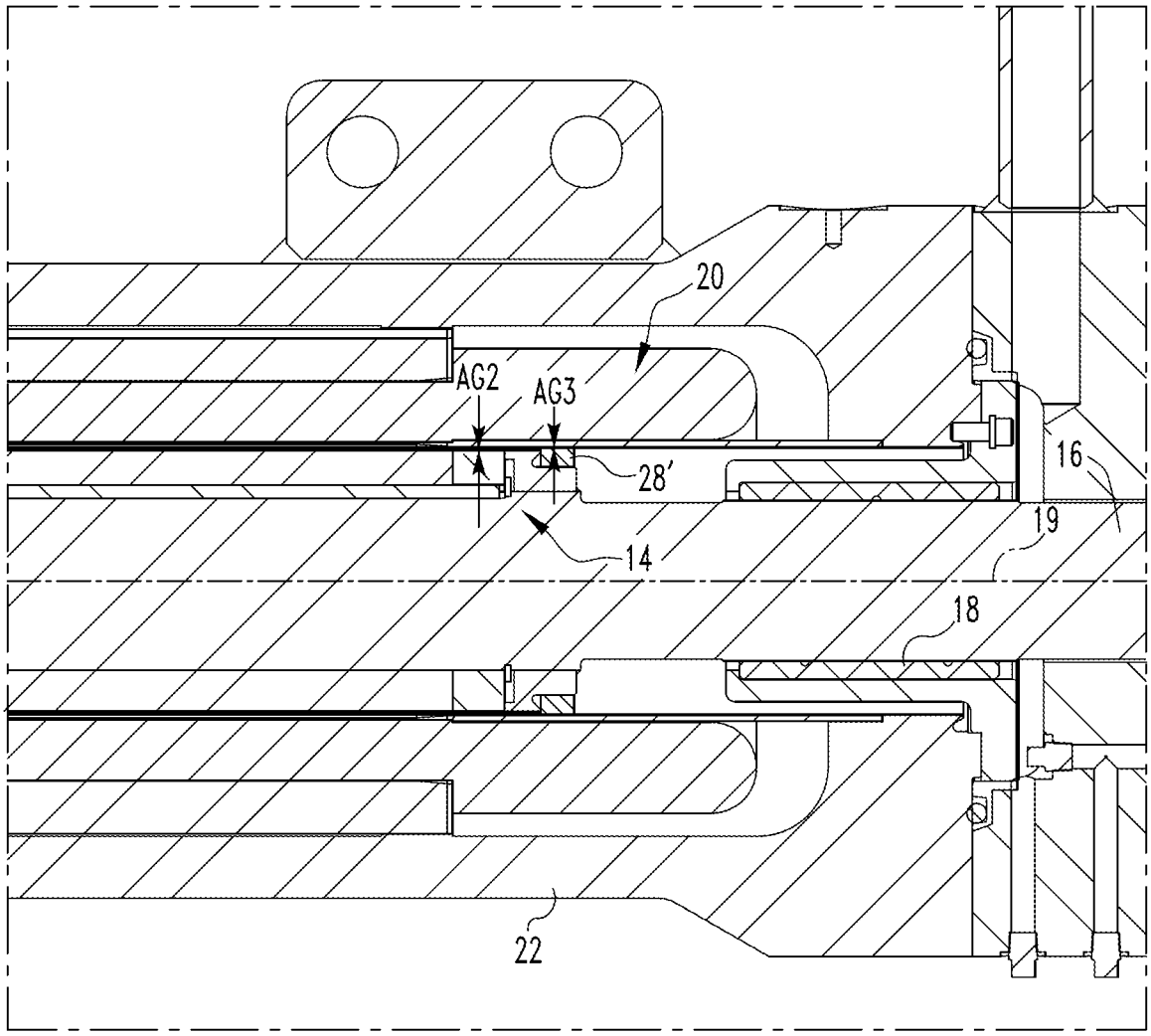
FIG. 9 is a detail view similar to the detail view of FIGS. 3 and 8 of another canned motor pump but showing a limit ring positioned in accordance with yet another example embodiment of the disclosed concept.
Figure 10:
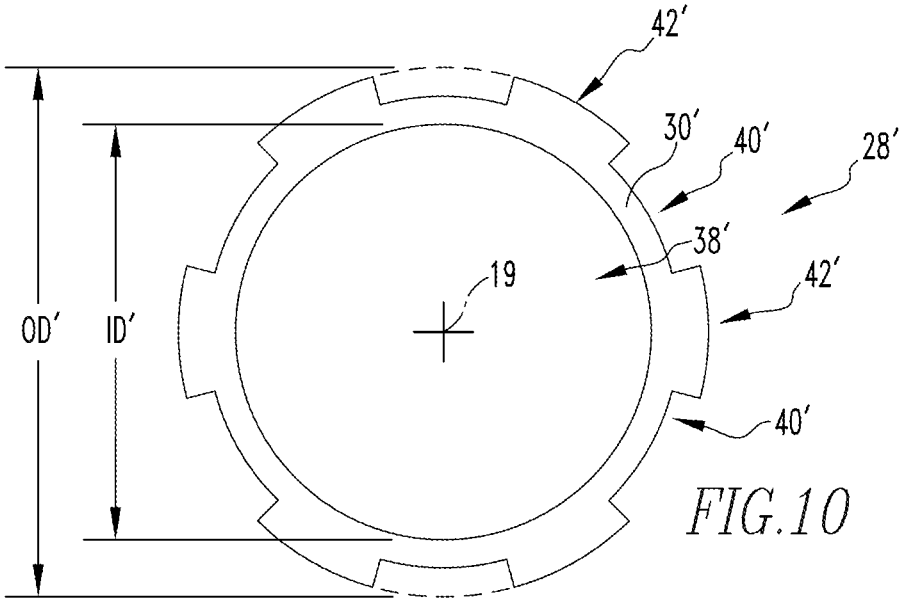
FIG. 10 is an end view of the limit ring of the arrangement of FIG. 9.

FIG. 9 shows another detail sectional view similar to the detail sectional view of FIGS. 3 and 8 of yet another similar canned motor pump in accordance with yet another example embodiment of the disclosed concept in which a differently shaped limit ring 28' positioned in yet a different location is employed. As can be appreciated in the end/axial view shown in FIG. 10, limit ring 28' is formed generally as an inverse of limit ring 28 previously discussed and shown similarly in FIG. 7. Hence, limit ring 28' includes a cylindrical body 30' positioned about longitudinal rotation axis 19 and having a first end and an opposite second end (not numbered) spaced along longitudinal rotation axis 19, as well as an inner diameter ID' and an outer diameter OD' perpendicular to longitudinal rotation axis 19. Limit ring 28' further includes a central passage 38' defined in cylindrical body 30' that is centered about, and extends along longitudinal rotation axis 19 from the first end to the second end of cylindrical body 30'. Central passage 38' has a circular cross section when viewed along longitudinal rotation axis 19. In addition to central passage 38', limit ring 28' further includes a plurality of channels 40' defined in cylindrical body 30' radially outward from central passage 38' that open radially outward from cylindrical body 30'. More particularly, each channel 40' extends radially inward into cylindrical body 30' from outer diameter OD'. Each channel 40' extends between the first and second ends of cylindrical body 30' parallel to longitudinal rotation axis 19. The example limit ring 28' includes a total of six channels 40', with each channel 40' having an opening running along, and opening into, outer diameter OD' of cylindrical body 30'. Each adjacent pair of channels 40' defines a lobe 42' of limit ring 28'. Hence, the example limit ring 28' shown in FIGS. 9 and 10 includes six lobes 42'. It is to be appreciated that one or more of the quantity, shape, and/or spacing of each channel 40'/lobe 42' can be varied without varying from the scope of the disclosed concept.

Unlike the previous example embodiments, in the example embodiment of FIG. 9 limit ring 28' is fit (e.g., snugly corresponding fit) to an end of rotor 14 and/or shaft 16 at or near an end of rotor 14. Outer diameter OD' of cylindrical body 30' of limit ring 28' is sized such that annular gap AG3 between cylindrical body 30' and the inner cylindrical surface (not numbered) of stator 20 is present that is less than annular gap AG2 between rotor 14 and stator 20. Such an arrangement would be the same at the opposite end of rotor 14. Hence, when either or both radial bearings 18 of such arrangement fail, contact would occur between the inner surface of stator 20 and lobes 42' of limit ring 28' before any contact would occur between rotor 14 and stator 20, thus causing the increases amp draw and tripping of the motor such as previously discussed.

Embodiments of the disclosed concept may readily be provided in a "kit" form for retrofitting pre-existing canned motor pumps. For example, a kit 50 or 52 including all or some of the components shown in FIGS. 5 and 6 may be providing for retrofitting a pre-existing motor pump. Accordingly, such a kit 50 or 52 may include one or more of: limit ring(s) 28, bearing support(s) 24 and/or 26, and radial bearing(s) 18. Such retrofit kit(s) 50 and/or 52 would provide for a conventional canned motor pump to be converted to a canned motor pump such as described herein by replacing the conventional bearing support(s) with bearing supports 24 and/or 26 as described herein along with the corresponding limit ring 28 and radial bearing 18 (which may be re-used depending on the particular application).

From the foregoing examples it is to be appreciated that embodiments of the disclosed concept provide arrangements that prevent rotor/stator contact in the event of a bearing failure in a canned motor pump. As such arrangements serve as a passive safety feature, embodiments of the disclosed concept can be readily integrated with existing safety systems in new pumps and/or existing applications. Although described in conjunction with canned motor pumps, it is to be appreciated that arrangements in accordance with the disclosed concept may also be applied to other applications in which one or more journal bearings are employed and in which a failure of such bearing(s) could lead to catastrophic destruction of components of the particular application.

Although the disclosed concept has been described in detail for the purpose of illustration based on what is currently considered to be the most practical and preferred embodiments, it is to be understood that such detail is solely for that purpose and that the disclosed concept is not limited to the disclosed embodiments, but, on the contrary, is intended to cover modifications and equivalent arrangements that are within the spirit and scope of the appended claims. For example, it is to be understood that the disclosed concept contemplates that, to the extent possible, one or more features of any embodiment can be combined with one or more features of any other embodiment.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A canned motor pump comprising:

a main housing;

a rotor having a shaft extending from both a first end and an opposite second end of the rotor;

a first radial bearing positioned in a first bearing support coupled to the main housing, the first radial bearing supporting the shaft extending from the first end of the rotor;

a second radial bearing positioned in a second bearing support coupled to the main housing, the second radial bearing supporting the shaft extending from the second end of the rotor;

a stator having a generally tubular shape positioned within the main housing radially outward from the rotor such that an annular gap is defined between the rotor and the stator; and a limit ring positioned adjacent at least one of the first or second radial bearings, wherein the limit ring comprises:

a cylindrical body positioned about a central longitudinal axis and having a first end and an opposite second end;

a central passage defined through the cylindrical body centered about, and extending along the longitudinal axis between the first end and the second end, the central passage having a circular cross section when viewed along the longitudinal axis; and a plurality of channels defined in the cylindrical body radially outward from the central passage, each channel extending between the first end and the second end, wherein the limit ring is positioned about the shaft extending from one of the first end of the rotor or the second end of the rotor such that the shaft extends through the central passage of the limit ring, and wherein a portion of the limit ring between a pair of the channels is spaced a distance from an adjacent portion of the canned motor pump that is less than a minimum distance between the rotor and the stator.

2. The canned motor pump of claim 1, wherein each channel of the plurality of channels of the limit ring opens into the central passage of the limit ring.

3. The canned motor pump of claim 1, wherein each channel of the plurality of channels of the limit ring opens outward from the cylindrical body of the limit ring.

4. The canned motor pump of claim 1, wherein each channel of the plurality of channels extends in a straight line parallel to the longitudinal axis.

5. The canned motor pump of claim 1, wherein the cylindrical body of the limit ring is formed from a high friction material.

6. The canned motor pump of claim 1, wherein:

the limit ring is a first limit ring;

the first limit ring is positioned adjacent the first radial bearing and is positioned about the shaft extending from the first end of the rotor such that the shaft extends through the central passage of the first limit ring;

the canned motor pump comprises a second limit ring comprising:

a cylindrical body positioned about a central longitudinal axis and having a first end and an opposite second end;

a central passage defined through the cylindrical body centered about, and extending along the longitudinal axis between the first end and the second end, the central passage having a circular cross section when viewed along the longitudinal axis; and a plurality of channels defined in the cylindrical body radially outward from the central passage, each channel extending between the first end and the second end;

the second limit ring is positioned adjacent the second radial bearing about the shaft extending from the second end of the rotor such that the shaft extends through the central passage of the second limit ring; and wherein a portion of the second limit ring between a pair of the channels of the second limit ring is spaced a distance from an adjacent portion of the canned motor pump that is less than the minimum distance between the rotor and the stator.

7. The canned motor pump of claim 1, wherein:

the limit ring is positioned in one of the first bearing support or the second bearing support;

each channel of the plurality of channels of the limit ring opens into the central passage of the limit ring; and the portion of the limit ring between the pair of the channels of the limit ring is spaced the distance from the shaft extending from the first end of the rotor or the second end of the rotor.

8. The canned motor pump of claim 1, wherein:

the limit ring is positioned in a portion of the stator;

each channel of the plurality of channels of the limit ring opens into the central passage of the limit ring; and the portion of the limit ring between the pair of the channels of the limit ring is spaced the distance from the shaft extending from the first end of the rotor or the second end of the rotor.

9. The canned motor pump of claim 1, wherein:

the limit ring is positioned about the shaft extending from the first end of the rotor or the second end of the rotor;

each channel of the plurality of channels of the limit ring opens outward from the cylindrical body of the limit ring; and the portion of the limit ring between the pair of the channels of the limit ring is spaced the distance from a portion of the stator.

* * * * *